US005525021A

United States Patent [19]

Larguier

[11] Patent Number: 5,525,021

[45] Date of Patent: Jun. 11, 1996

[54] DEVICE FOR THE PLACEMENT AND IF DESIRED THE COLLECTION OF TRAFFIC CONES

[75] Inventor: Frederic Larguier, Lavalette, France

[73] Assignee: Baltic Ingenierie, Carquefou Cedex, France

[21] Appl. No.: 301,706

[22] Filed: Sep. 7, 1994

[30] Foreign Application Priority Data

Sep. 7, 1993 [FR] France ..... 93 10696

[51] Int. Cl.[6] ..... B60P 1/40

[52] U.S. Cl. ..... 414/551; 414/788.2; 414/795.6

[58] Field of Search ..... 414/551, 788.2, 414/789.7, 795.6

[56] References Cited

U.S. PATENT DOCUMENTS 4,597,706 7/1986 Michit ..... 414/798.7

FOREIGN PATENT DOCUMENTS 0501106 9/1992 European Pat. Off. .
2556378 5/1986 France .
2657313 7/1991 France .
2747183 4/1978 Germany .

*Primary Examiner* David A. Bucci
*Assistant Examiner* Janice L. Krizek
*Attorney, Agent, or Firm* Young & Thompson

[57] ABSTRACT

A vehicle-mounted device for positioning traffic cones (14) on the street and for collecting them from the street. Each cone has a conical hollow body (15) and a base (16). The cones are stacked and nested in a supply (8) comprising a hollow vertical body open at least at its base (28) to permit the reception of the base (16) of a cone. A platform (4) is disposed about a vertical axis (10) and disposed below the base (28) of the supply (8). The platform (4) has at least one opening (6) and a fork formed of two fingers (7) which are substantially horizontal and are spaced from each other in a direction radially of the platform so as to let pass only the body (15) of a cone and not the base (16) of the cone. These fingers are disposed at a height (H) above the platform (4) at least equal to the thickness of the base (16) of a cone such that in the course of movement of the supply (8) and the platform (4) relative to each other in rotation about the vertical axis (10) in a direction such that the fingers of the fork enter the stack of cones contained in the supply, the opening (28) of the supply will pass above the opening (6) provided in the platform (4) and the fingers (7) of the fork will penetrate between the bases (16) of the last cone (14) of the stack in the supply and the next-to-last cone, thereby detaching from the stack during such relative displacement the last cone which then descends to the street and retaining the next-to-last cone. Much the same structure can be used during collection of the cones from the street.

11 Claims, 9 Drawing Sheets

DEVICE FOR THE PLACEMENT AND IF DESIRED THE COLLECTION OF TRAFFIC CONES

FIELD OF THE INVENTION

The present invention relates to a device on an automotive or trailer vehicle for the automatic placement and if desired the collection of traffic cones.

BACKGROUND OF THE INVENTION

Traffic cones are placed on roads and highways at regular intervals to deflect the traffic from a lane that is to be taken out of operation. These are generally plastic cones, having a hollow conical body, provided at its end opposite the summit with a flat base having a generally square outline. To place them, the cones are transported by a driven or trailer vehicle in the form of stacks by interfitting within each other. Their distribution is effected by personnel riding the vehicles and requires two operations, one taking a cone from the stack and giving it to the operator who places it on the street. Such an operation is not without danger. Moreover, it is difficult in this case to ensure a distribution of the cones at regular intervals. It has therefore been sought in certain cases to render automatic or semiautomatic certain phases of each of these operations.

German patent DE-A-2.747.183 discloses a device for the automatic placement of cones in which the cones, stored in stacks, are successively moved into vertical position above an opening through which each cone is capable of falling by simple gravity, a plate and a movable fork acting alternatively in synchronous manner, the one freeing the lowermost cone while the other holds back the cone immediately above in said pile, the opposite movement of each of these forks permitting the second cone to take its place on said plate for the next emplacement while the upper fork itself is in place to retain the upper cones. Such a cone system requires perfect synchronism between the various movable elements to ensure distribution of the cones. However, it is known that because of the properties of the cones, namely their ability to deform at high temperatures and their heterogeneity arising from variations in shape during manufacture, only a static distribution system not requiring adjustment, offers maximum dependability. Moreover, such a device cannot be used again to collect the cones.

Another device described in French patent FR-A-2.657.313 is comprised by a wheel placed on the side of the truck. This wheel is constituted by two rotatable truncated conical circular panels which delimit between them a space capable of receiving the cones and gripping them for moving them. The problem with this device resides in the fact that the supply and the collection of the cones require the presence of an operator who must supply or collect one by one the cones disposed along the street.

A completely automatic system has on the other hand been described in French patent FR-A-2.556.378. This device is complex and cumbersome because of the presence of numerous chutes and conveyor belts. It is to be noted that, in this device, the placement of the cones has the same drawbacks as those cited in the case of German patent No. 2.747.183. Thus, each supply comprises at its lower end two superposed abutments which engage respectively below the last or next-to-last cone, which abutments are actuated by articulated levers which are interconnected by a strap such that the lower abutment is withdrawn and lets fall one cone, while the upper abutment is engaged below the next-to-last cone, and vice versa.

All of these devices requiring delicate synchronism and the displacement of members have shown their limit of reliability with time.

SUMMARY OF THE INVENTION

The present invention therefore has for its object to provide a device permitting the positioning and if desired the collection, entirely automatically and reliably, of traffic cones, by means of a simple and lightweight device capable of being easily emplaced in a removable manner on an automotive or trailer flatbed vehicle without requiring any other operator than the driver of the vehicle.

Another object of the invention is to provide a device for placing and if desired collecting traffic cones by means of fixed emplacement members that do not require working in synchronism, the emplacement means being adapted to be reused for collecting.

The invention relates to this end to a device on an automotive or trailer vehicle, for emplacing and if desired collecting traffic cones constituted by a hollow conical body provided with a base, these cones being stored superposed by nesting in a stack within at least one supply having the shape of a vertical hollow body open at least at its base, to permit the passage of one cone base, characterized in that it comprises a platform disposed about a vertical axis beneath the opening of said supply, said platform comprising at least one opening to permit the passage of at least one cone base and a fork formed of two substantially horizontal fingers spaced radially apart so as not to let pass more than one cone and whose free ends are located facing a radial edge of said opening at a height H above the platform at least equal to the thickness of the base of one cone, such that, in the course of displacement of the supply and/or of the platform by a movement of relative rotation about said vertical axis in a direction such that the fork attacks by its points the stack of cones contained in the supply, the open base of the supply will pass above the opening provided in the platform, the fingers of said fork penetrating between the bases of the last cone in the pile in the supply and the one immediately above, thereby detaching from the pile, during the course of this displacement, the last cone which is to be disposed on the street and retaining the cone immediately above.

According to a preferred embodiment of the invention, the platform is constituted by at least one turn of a helicoidal ramp whose pitch is at least equal to the thickness of the base of a cone.

BRIEF DESCRIPTION OF THE DRAWINGS

The invention will be better understood from a reading of the following description of embodiments, with reference to the accompanying drawings, in which.

DETAILED DESCRIPTION OF THE INVENTION

Figure 1:
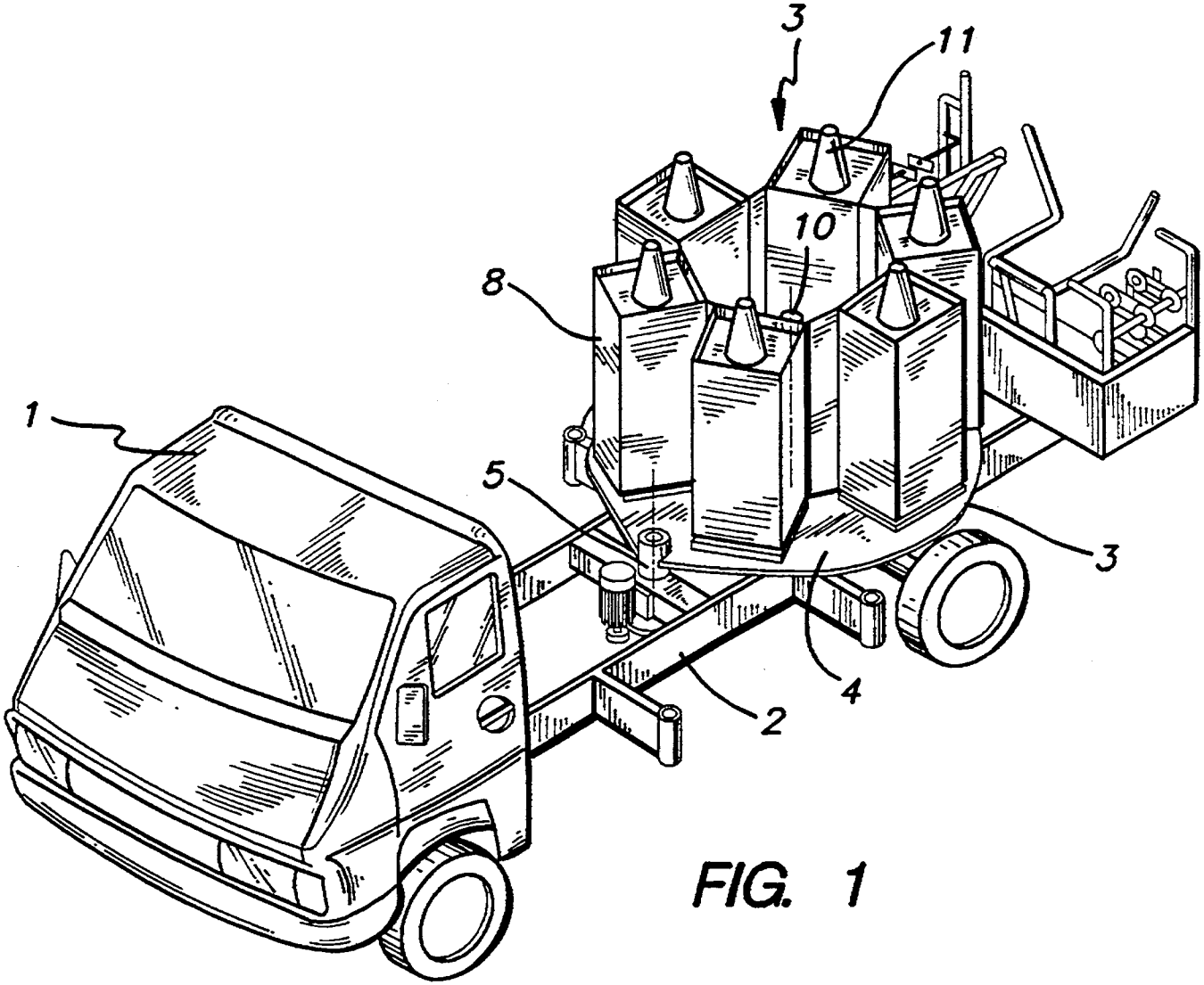
FIG. 1 is a perspective view of a device according to the invention.

The device according to the invention is adapted to permit the placement and if desired the collection of traffic cones. These traffic cones are nowadays substantially all identical. These cones 14 comprise a hollow conical body 15 whose end opposite the summit of the cone is provided with a generally square base 16. These cones are used on roads and highways to signal and to mark construction sites or obstacles.

This device according to the invention, which permits either the positioning or the collection of said cones during the advance of a vehicle, can be installed on the platform of an automotive vehicle or on the platform of a drawn trailer. This device can be designed to be transformable between a transportation system on the roadway and a working position. In this case, in the travelling position, the device is in accordance with the roadway clearance and comprises no element extending beyond this clearance. On the contrary, in position for collecting or emplacing the cones, the positioning or collecting device is located to one side of the vehicle which can also be the rear of the vehicle, such that the latter can travel along a line so as to position or collect the cones. The positioning of the cones can also be effected either during forward movement or rearward movement of the vehicle. This device therefore comprises a structure 3, a platform support 4, which can be supported on the flatbed or chassis or any other equivalent means 2 of the vehicle 1. The connection means between this support or frame 3 of the device and the chassis 2 of the vehicle can be as desired. However, it is preferable that the device can be taken off the vehicle when it is not used, thereby rendering the vehicle available for any other use. This frame 3 of the device, in addition to the fact that it can be mounted removably on the element 2 forming the flatbed or platform of the vehicle 1, can also be mounted movably on this chassis 2 of the vehicle so as to pass from a traveling position to a working position. To be able to pass from a traveling position to a working position, either the assembly of the frame 3-platform 4 is movable relative to the platform or flatbed 2 of the vehicle 1, or only the platform 4 is movable relative to the frame 3. These displacement means of the platform 4-frame 3 assembly, or platform 4 alone, are for example constituted by an axle of rotation, such as a pivoting axle 5, whose rotation is controlled by suitable means. The object of this displacement is to bring at least one opening 6 provided in said platform above the street so as to permit the positioning and collection of the cones on or from the street. It is also possible, in the case in which the vehicle has only a single position corresponding to the working and travel positions, to make the platform 4 such that the openings 6 provided in this platform are always located above the street. In this case, however, the size of the device will be relatively great.

Figure 3:
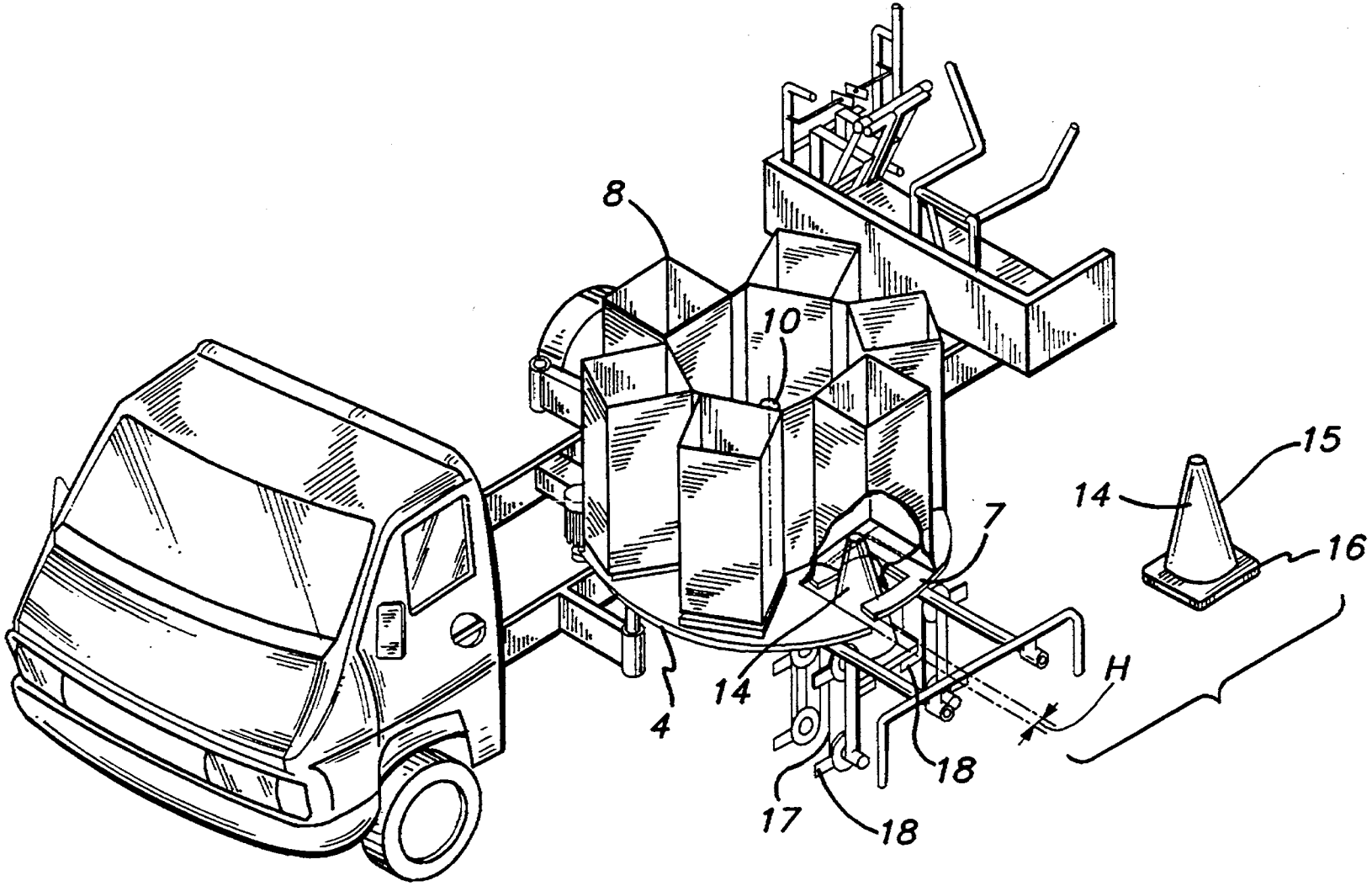
FIG. 3 is a perspective view partially broken away showing the means ensuring the vertical descent of the cone leaving the supply, the assembly of the device being positioned laterally offset from the vehicle.

In addition to the platform 4 arranged about a vertical axis 10, the device for emplacing and if desired collecting the cones comprises at least one supply 8. The platform 4 and the supply or supplies 8 are mounted for relative rotation about said generally vertical axis 10. The supply 8 is present in the form of a hollow vertical body open at least at its base, to permit the passage of a base 16 of a cone, the platform 4 being disposed below the open base of said supply. In the example shown in FIGS. 1 and 3, this supply is of square shape in transverse cross section and is open at its two ends. To optimize the emplacement and if desired the collection of the cones, there are generally provided several supplies 8 radially disposed regularly about the axis of rotation 10 to form a turret 9 and means to drive the supplies 8 step by step, each step corresponding to the angular spacing between two successive supplies. However, other arrangements are possible (turning platform/fixed supply; supplies and platform turning . . . ).

Figure 2:
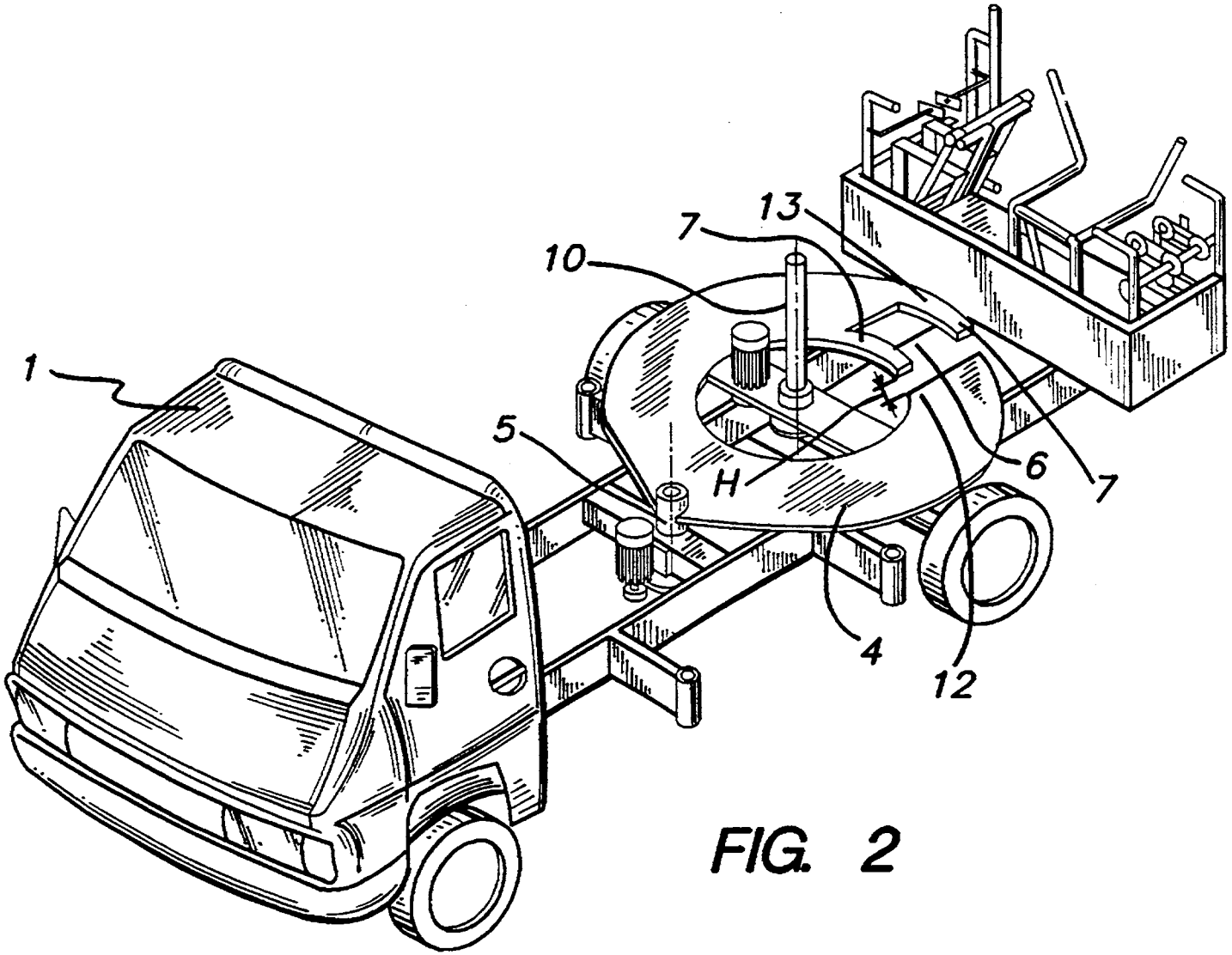
FIG. 2 is a perspective view of a vehicle showing the circular platform above which turns the turret of supplies of cones.

As described above, the platform 4, continuous or discontinuous, has at least one shaped opening 6 to permit the free passage of the base of a cone and comprises at least one fork. In the example shown in FIGS. 1 and 3, the discontinuous platform 4 is constituted of at least one turn of a helicoidal ramp whose pitch is at least equal to the thickness of the base 16 of a cone. The opening 6 of the platform therefore corresponds to this break in the continuity of the platform 4 and in particular to the free space between the upper end 13 and the lower end 12 of the platform 4. Other configurations in which the platform is continuous are however imaginable. In this case, the platform could comprise a through opening 6 permitting the free passage of the base of a cone. The fork could therefore according to the shape of the platform be disposed at the upper end 13 of the platform 4 and if desired be formed from a single piece with this latter, as is shown in FIG. 2, or on the contrary to constitute an element, turned back or not, disposed above the opening 6 provided in the platform 4. This fork is formed of two fingers 7 which are substantially horizontal, and radially spaced so as to let only the body 15 of a cone pass and therefore the free ends will be located facing a radial edge of said opening 6 of the platform 4 at a height H above the platform 4 at least equal to the thickness of the base 16 of a cone.

Figure 4A:
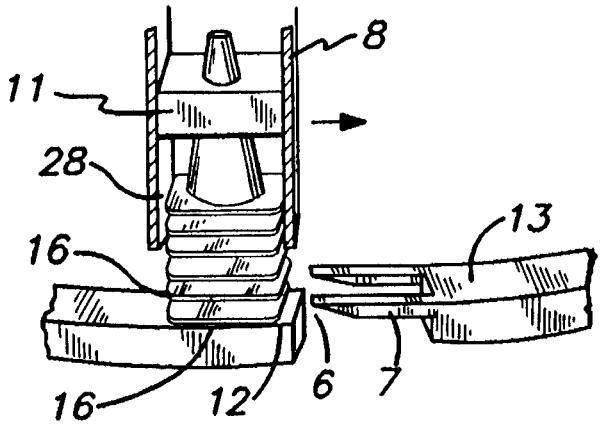
FIGS. 4*a* through 4*c* are fragmentary perspective views showing the different steps of the process of emplacing the stored cones in a supply shown in vertical cross section.
Figure 4B:
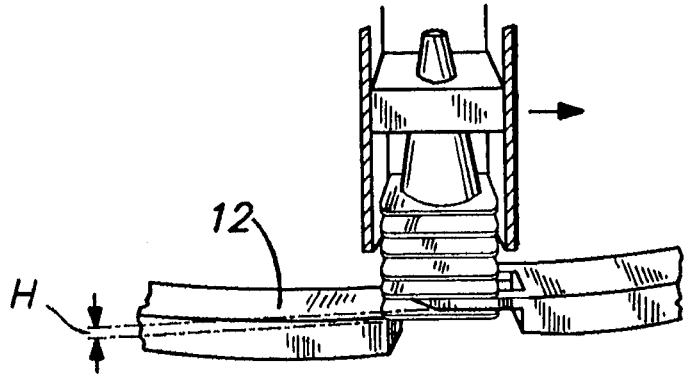
Figure 4C:
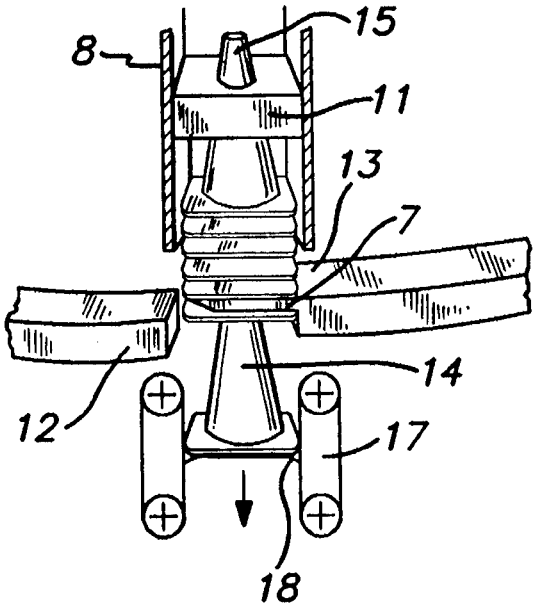

Generally, the surface of the platform 4 is constituted of rollers (not shown) disposed transversely, which promotes, as will be seen hereinafter, the displacement of the base of the cone along the surface of said platform. Moreover, in this case, it could also be provided that certain rollers constituting the platform be driven, again to promote the advance of the cones along the platform. The cones 14 are themselves stacked vertically within the supplies 8 in their usual position, which is to say base downward and are nested within each other. Each supply 8 comprises internally, adjacent the upper end, a floating cap or feeler, free to displace axially within the supply between the extreme positions delimited by abutments along the internal walls of said supply to follow the cones not only during the course of their stacking into the supply but also during their withdrawal from the supply. This floating cap 11 comprises at least one opening with a profile complementary to the body 15 of the cone to maintain centered the cones thus axially guided within said supply. The role of this floating cap will become clearer during the description of the operation of the device for placing or collecting the cones. As described above, because of the configuration of the platform 4 shown in the figures, this platform comprises a lower end 12 and an upper end 13, spaced from each other by a distance at least equal to the thickness of the base 16 of a cone 14. The fork is thus provided at or adjacent the upper end 13 of the platform 4. This fork, as described above, is formed with two fingers 7 spaced apart a distance which permits only the free passage of the body 15 of a cone. In this way, during rotation of the supply 8 or the platform 4, the open base of the supply 8 is caused to pass above the opening 6 provided in the platform 4, the fingers 7 of said fork then penetrating between the bases of the last cone in the stack and the one immediately above, thereby detaching from the stack the last cone adapted to be disposed on the street. These fingers 7, because of their spacing, retain the next-to-last cone, the base of the last cone passing through the opening 6. The penetration of the fingers between the bases of the cones is possible only from the moment in which the supply or the platform turns in a direction such that the fork attacks by its points the stack of cones as shown in FIGS. 4*a* to 4*c*. Moreover, to promote the detachment of the bases of the cones from each other, the fingers 7 will preferably be sharpened at their free ends.

The last cone in the stack contained in the supply 8 thus freed must be accompanied to the outlet of the opening 6 of the platform 4 to be adapted to be disposed correctly on the street. An example of embodiment of these accompanying means is shown in FIG. 4*c*. In this case, the accompanying means are constituted by two runs of vertical conveyors 17 that are generally parallel to each other, located below the fork adjacent the outlet of the opening 6 of the platform 4. These conveyors are spaced from each other a distance at least equal to the width of the base 16 of the cone and comprise lugs 18 which move synchronously and against which the cone comes to bear such that, when the lugs arrive adjacent the street, they free the cone onto the street in vertical position. These accompanying means can be provided retractably so as not to be outside the traffic lane in the transport position. Of course detectors placed at appropriate points permit an operation of the accompanying means that is appropriate relative to the movement of rotation of the supplies and/or the platform 4, the assembly of the operations being subject to the distance traversed by the vehicle so as to ensure distribution in an equidistant fashion of the cones on the street. The positioning device such as described above is therefore a stationary device. Thanks to such a positioning device, there is avoided an escapement mechanism movable alternatingly below a same stack of cones for distributing them individually until they are exhausted. By the same token, alternating control members for the escapement generally used are avoided.

Figure 9:
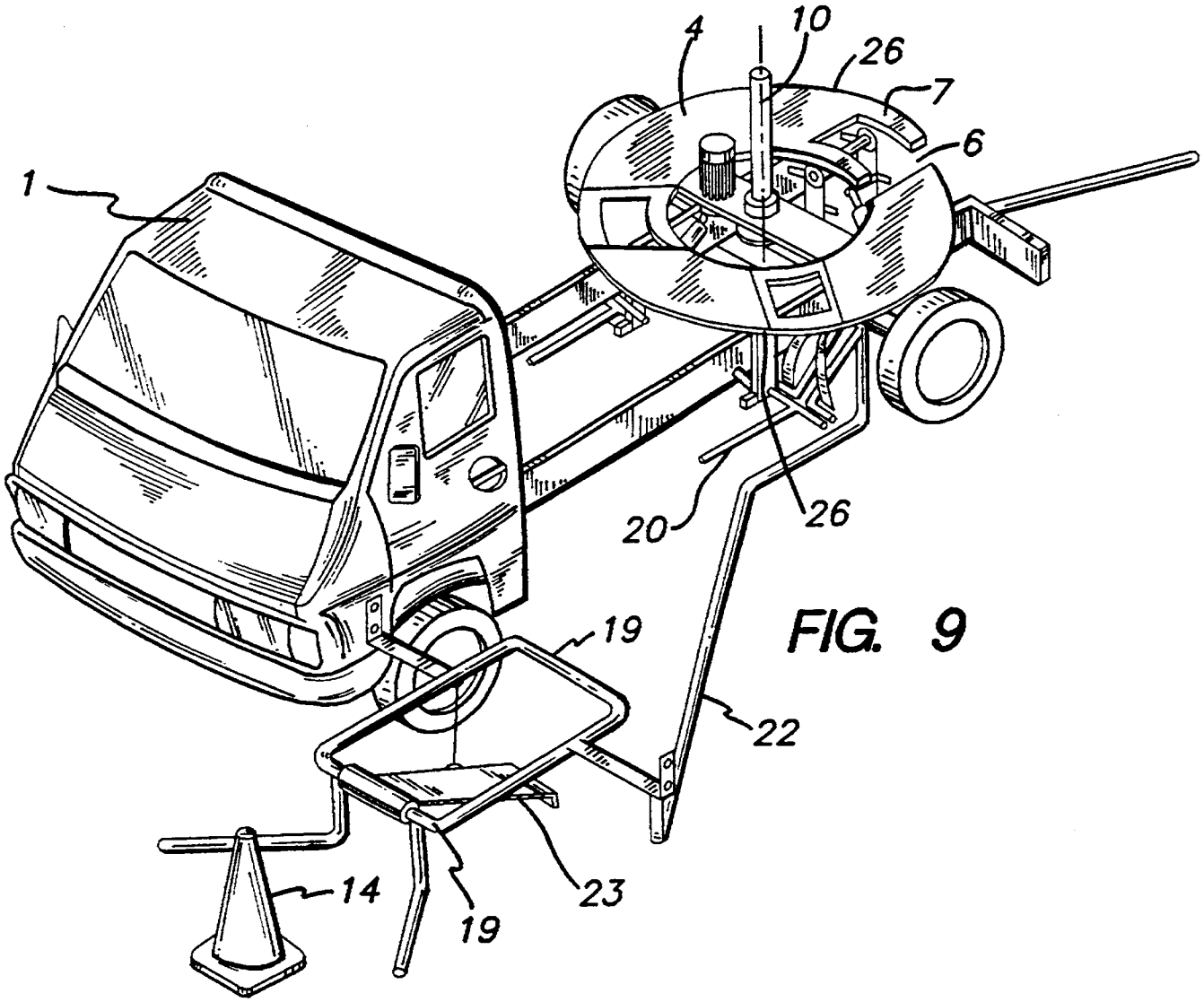
FIG. 9 is a view from above of a vehicle without the supply, provided with a circular platform with multiple openings.

According to a modification of the invention, the fingers 7 of the fork can be movable, particularly articulated at their heel at 26, as shown in FIG. 9. Because of this, it is possible, thanks to these articulations, to maintain the distance between the lower end of the platform 12 and the upper end of the platform 13 constant, by readjusting this height with time, this height having been changed by wear on the device. The other advantage results from the fact that the platform 4 can have several openings 6, as shown in FIG. 9, in particular in the case in which the device is designed so as not to be able to occupy two positions, a working position and a traveling position. In this case, the openings 6 are so provided as to permit positioning of cones as desired to the left, to the right, even to the rear of the vehicle. It will therefore be necessary to reduce the upper surface of the fingers by leveling the upper surface of the platform when the opening is not used. Thus, in the absence of such an adjustment, the fingers would constitute an abutment in the course of movement of the cone on the platform, which could give rise to wedging, and even to damage of the device.

As described above, the process for emplacement shows that this operation can be conducted by a single person without any manual intervention other than driving and controlling the vehicle.

Figure 5A:
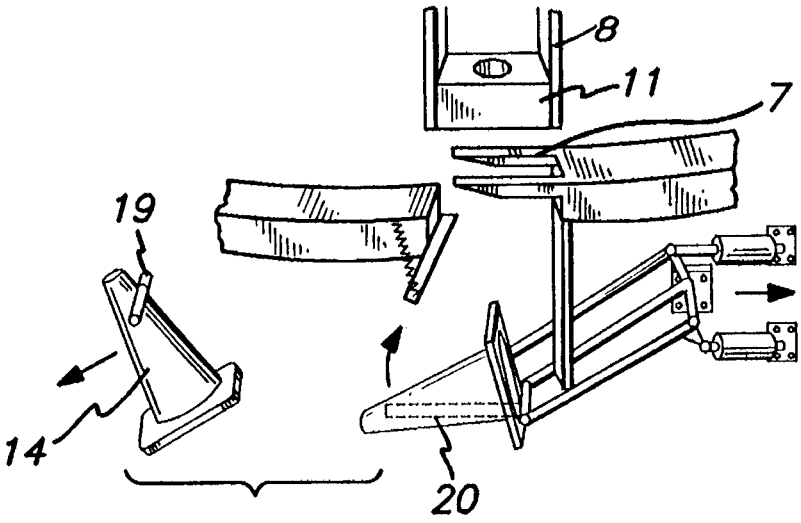
FIGS. 5*a* through 5*c* are fragmentary perspective views showing the different steps of the process of collecting the cones to be stored in a supply shown in vertical cross section.
Figure 5B:
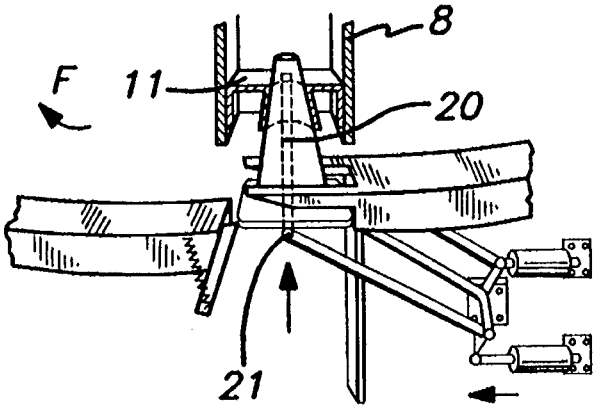
Figure 5C:
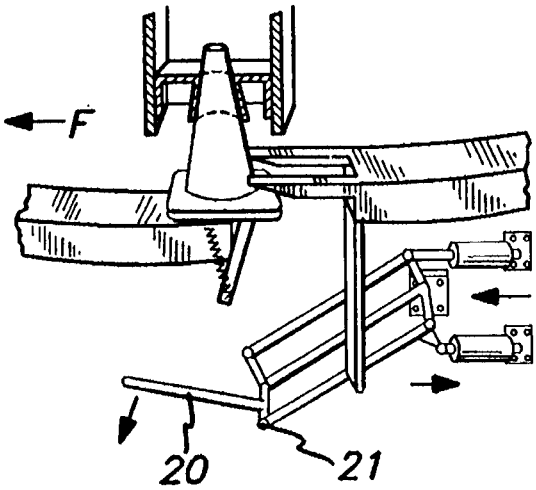

The gathering device, as described hereafter, will show that this advantage is equally applicable to the operation of collecting. Thus, the device according to the invention comprises moreover a collecting device. This collecting device is constituted by overturning means 19 for the cone 14 to lay it on the ground. These overturning means can be as simple as a bar disposed perpendicular to the longitudinal axis of the vehicle on one of the sides of this latter, and fixed either to the vehicle or to the device. This bar is situated at a height from the street less than the total height of the cone. In addition to these overturning means 19 and downstream of these latter, the collecting device comprises means 20 for erecting the cone which, in the course of advance of the vehicle, penetrate the interior of the laid-down cone to erect it by pivoting of said means. Generally, and as shown in FIGS. 5*a* to 5*c*, these erecting means for the cone are, by way of example, constituted by a spear 20 pivotally mounted about a pivotal axis 21 such that this spear can occupy a first so-called low horizontal position parallel to the direction of movement of the vehicle at a distance from the ground substantially equal to half the diameter of a cone so as to be able to penetrate, when the vehicle advances, a cone which lies on the ground in alignment, and a so-called upper position, in which the spear 20, after having penetrated within the cone, this penetration having been detected by means of a suitable detection member, erects the cone by pivoting about its pivotal axis 21 thereby picking up the cone and bringing the cone either directly above the upper surface of the platform into contact with the lower surface of the fingers 7 of the fork, or into contact with the accompanying means as described above constituted by two parallel conveyors 17 which serve in particular for positioning said cones. It is to be noted that, during operation of the spear 20, in particular for the passage of this latter from the lower position to the upper position, a supply occupies a position in which it is located above the fork, such that the free space between the fingers faces the open base 28 of the supply 8. Thus, the cone raised by the means described above penetrates between the fingers 7 of the fork and then into the supply which is above it without having to raise the cones already introduced which themselves are supported by the fork. This cone, once in contact at the level of its base with the lower portion of the fingers 7 of the fork and/or disposed above the surface of the lower end 12 of the platform 4, triggers a new rotation of the supplies (FIGS. 5*b*, 5*c*) about the axis 10 in the direction of the arrow F corresponding to a direction of rotation in which each supply approaches the fork with its heel, this rotation driving the cone on the lower end 12 of the platform and permitting, during the course of rotation of the supply, the final introduction of this latter within the supply. Parallel to the advancement of the cone to the upper surface of the platform 4, the spear 20 repositions itself in the lower position awaiting the next cone. The interest of such a gathering device is to use identical means to those used for positioning the cone.

In the case of such a gathering device, it will be understood that the purpose of the floating cap 11 is to play a guiding role for the cone introduced within the supply, in particular when the supply 8 is empty.

It frequently happens along the roadways that the cones are no longer necessarily aligned when the gathering operation is conducted. Thus, they can have been knocked over by automobiles or even simply displaced. As a result, to perfect the gathering device and to improve its reliability, there is integrated with the gathering device guide means for the cones so as to bring these cones into general alignment. These guide means can be for example constituted of arms 22 (a single one is shown in FIG. 9) which converge between the overturning means of the cones 19 and the vertical alignment means by pivoting of the spear 20, these arms 22 delimiting a guide path substantially in the shape of a funnel, the inlet of the guide path adjacent the overturning means 19 corresponding to the large end of the tunnel. Because of this, in such a device, the cones not knocked over can be knocked over by means of a swinging bar 19 disposed at the inlet of said guide path, or before this latter, in the direction of advance of the vehicle, then the cone, once it has entered the guide path, displaces along said arms to be brought into contact with the erection means that pivot the cone, in this case the spear 20, to be able thereafter to follow a path analogous to that which has been described above. It should be noted that the guide arms 22 are situated at a height relative to the ground less than the height of the base 13 of a cone lying on the ground.

Figure 6A:
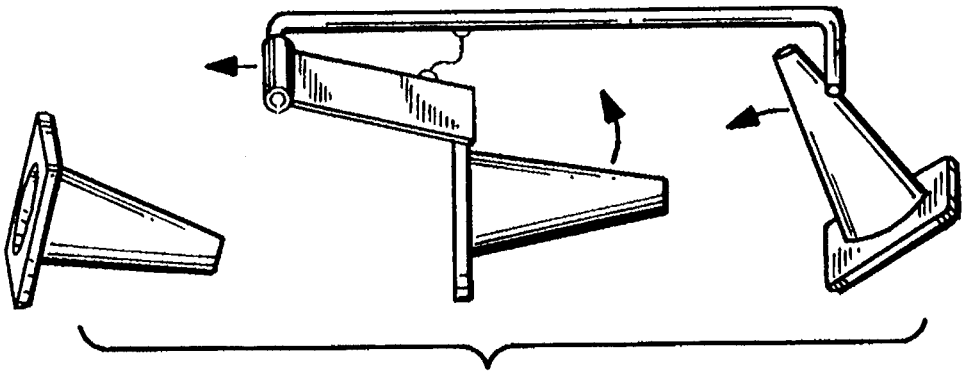
FIGS. 6*a* and 6*b* are perspective views of the device permitting positioning the cones always in a position to be speared, no matter what their initial position on the roadway.
Figure 6B:
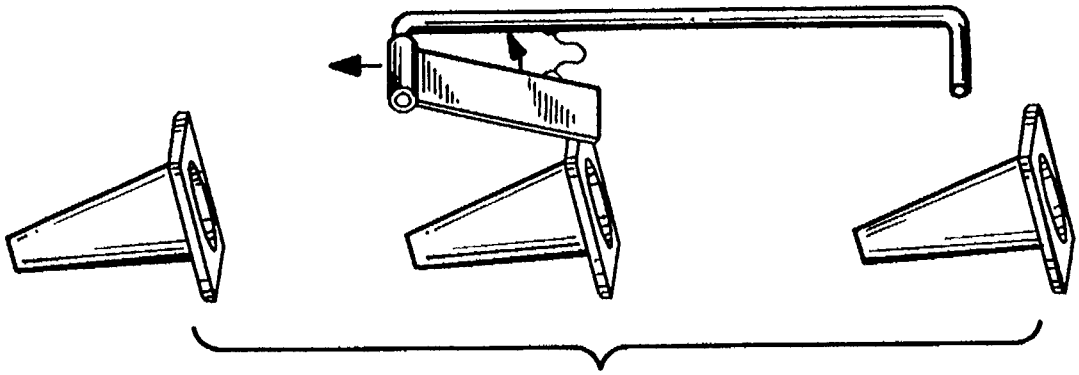
Figure 7A:
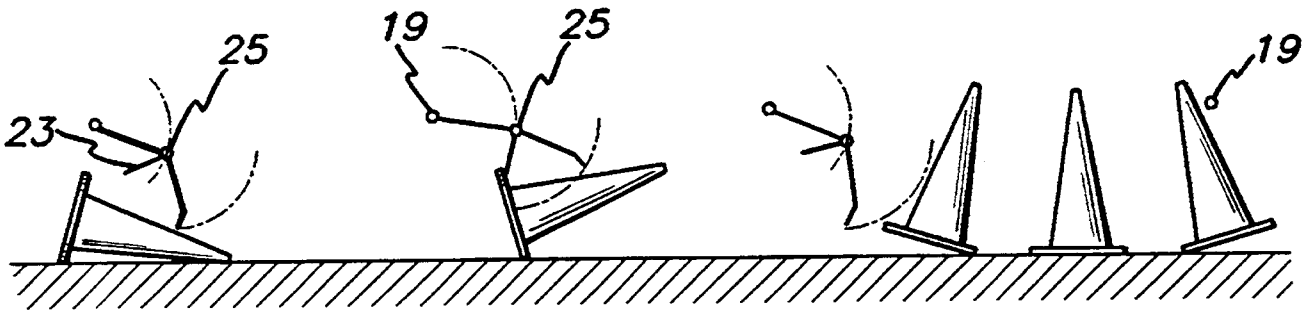
FIGS. 7*a* to 7*c* show a modification of the device of FIGS. 6*a* and 5*b;*

There exists a configuration in which it is however impossible, even with such a guide path, to permit the penetration of the spear 20 within the cone. This configuration is shown in FIGS. 6*a* or 7*a* and corresponds to the case in which the cone enters the guide path point first. In this case, it is necessary that the entry of the guide path be provided with a corrector 23 which permits, during advance of the vehicle, a rotation by 180° about their base of the cones which point into the guide path, so that the erection means 20 by pivoting of the cone may then penetrate within the cone. Such an example of embodiment of a corrector is shown in FIGS. 6*a* to 7*c*. This corrector is constituted by a pivoting flap (FIG. 6*a*) or two flaps (FIG. 7*a*) having the shape of a dihedral 24 still of identical shape, this dihedral pivoting about its edge 25 constituted by a pivotal axis disposed perpendicular to the longitudinal axis of the vehicle generally in front of this latter. This pivotal axis 25 is movable parallel to itself (FIG. 7*a*).

Figure 7B:
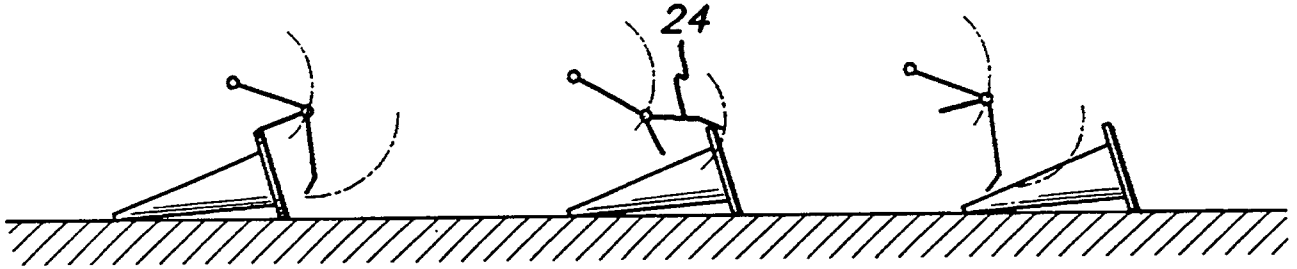
Figure 7C:
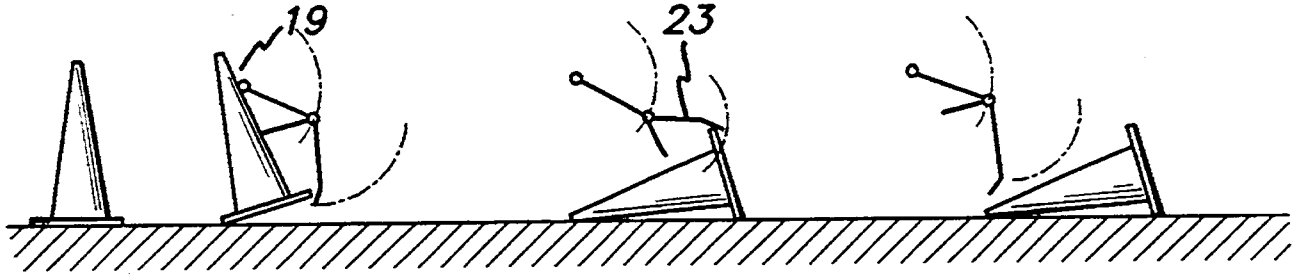
Figure 8A:
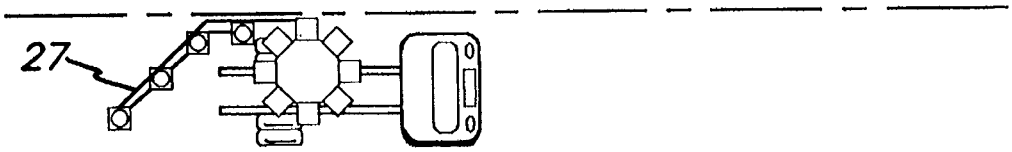
FIGS. 8*a* to 8*f* show simplified schematic views from above of a device provided with an arm permitting the emplacement of the cones on the bias.
Figure 8B:
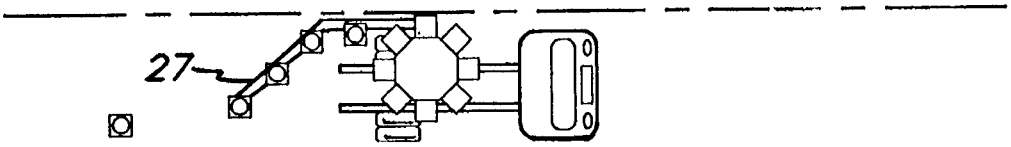
Figure 8C:
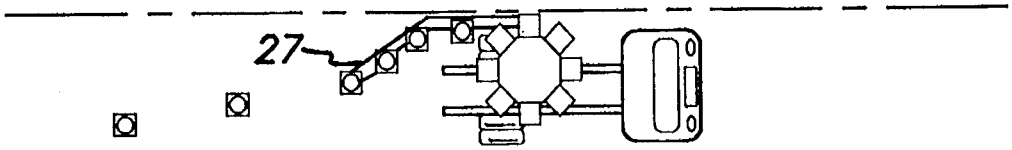
Figure 8D:
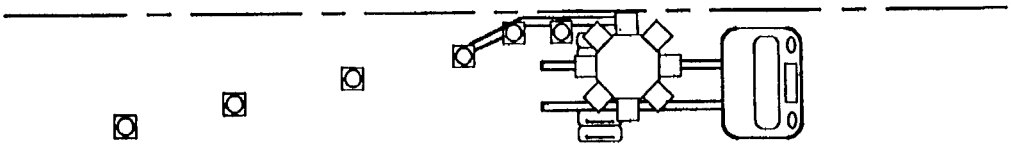
Figure 8E:
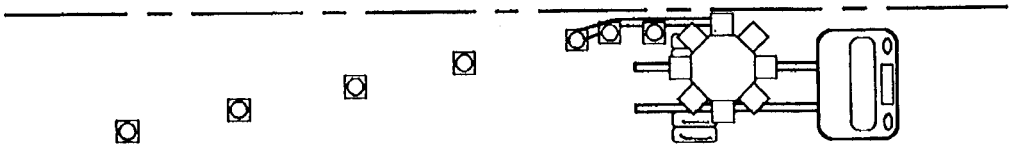
Figure 8F:
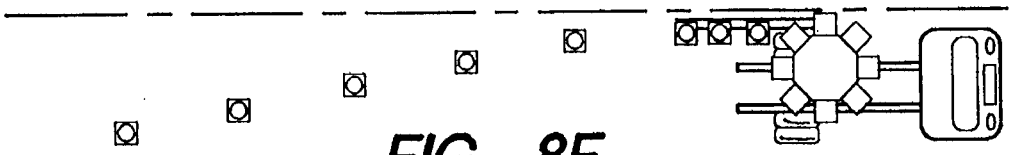

Thus, according to FIG. 7*a*, in the case in which the cone is point first in the guide path, one of the plates of the dihedral ending in a folded edge, namely the plate A, B, C and D, the points C and D being not visible, comes into contact with the summit of the cone causing thus in the course of the advance of the vehicle the rotation of the dihedral about its axis 25 and the displacement of the axis 25 parallel to itself to a position in which it is the free end of the other plate of the dihedral which comes to bear against the base of the cone thereby causing, in the continued advance of the vehicle, the correction of this latter so that it sits normally on its base. In all the other cases of presentation of the summit of the cone, this dihedral will serve only as a pivotal flap which freely lets the cone pass. FIGS. 6*a* and 6*b* are a less desirable modification of this corrector. As shown in FIGS. 7*a* to 7*c*, upstream of this corrector is disposed a swinging bar 19 which permits overturning the cone in the case in which this latter is upright. Moreover, it is evident as shown in FIG. 7*a* that once the correction of the cone has been effected if this latter is point first, it is necessary again to knock over the cone so that the spear 20 can enter the interior of this latter. A swinging bar thus will be provided in this case downstream of the corrector in the direction of advance of the vehicle.

There is still a last particular case shown in FIGS. 8*a* to 8*f* in which it is necessary to position the cones in the form of a diagonal in particular at the beginning of a positioning operation. To achieve this diagonal, an articulated arm 27 is arranged on the vehicle and/or on the device, said arm having an opening angle variable as a function of the advance of the vehicle, this angle generally opening in the course of the advancement of the vehicle to permit the positioning of cones on the bias. Thus, in the course of the displacement of the vehicle, the cones brought by the accompanying means 17, 18 onto the street are controlled by this arm against which they roll to come into position at the free end of this arm.

Finally, to ensure complete reliability of the device, this device should comprise means for maintaining the cone on its path on the plate in the course of rotation of the turret of supplies and/or of the platform. These means are particularly shaped as a ramp with vertical rollers disposed at the lower end 12 of the platform at the periphery of this latter.

Of course, the processes for positioning and gathering described above are applicable to each cone contained in each supply. Thus, for example, once the process of collecting has been applied to one cone of a supply, the collected cone continues to be displaced on the platform driven by the rotation of the supply which turns about the vertical axis 10 until the following supply of the turret has been brought vertically into the space provided between the fingers of the fork being thus ready to receive a new cone by the same process. The rotation of the turret of supplies will be stopped either automatically or by the driver of the vehicle upon the output of a signal occurring when the filling of all the supplies has been effected during the process of collecting or when the assembly of the supplies are emptied during the process of positioning, these signals being emitted by detectors positioned at suitable places.

It is also evident that all the accompanying devices, in particular those used for collecting cones, can be incorporated in the principal device and/or in the vehicle so as to achieve a compact assembly and thereby to facilitate the operation of such a device.

What is claimed is:

1. A device for a vehicle for positioning traffic cones on a street, each cone comprising a conical hollow body and a base (16), said device comprising: a supply for storing a stack of cones nested in superposed position comprising a hollow vertical body having an opening at least at its base to permit reception of the base of a cone, said device further comprising a platform disposed about a vertical axis and below said base of said supply, said platform comprising at least one opening and a fork formed of two fingers which are substantially horizontal and are spaced from each other in a direction radially of said vertical axis so as to let pass only the body of a cone and not the base of the cone, said fingers having free ends disposed adjacent the platform opening at a height above the platform at least equal to the thickness of the base of a cone, at least one of said platform and said supply being rotatable relative to the other about said vertical axis in a direction such that the fingers of the fork enter the stack of cones contained in the supply, when the opening of the supply passes above the platform opening and the fingers of said fork penetrate between the base of the last cone of the stack in the supply and the base of the next-to-last cone, thereby detaching from the stack during such relative displacement the last cone which then descends to the street, and retaining said next-to-last cone.

2. The device according to claim 1, further including a plurality of said supplies regularly spaced about said vertical axis and forming a turret, and means for driving said turret stepwise in rotation, each step of rotation equaling the angular space between two successive supplies.

3. The device according to claim 1, wherein the platform is a helicoidal ramp having a pitch at least equal to the thickness of the base of a cone.

4. The device according to claim 1, wherein the last cone, detached from the stack of cones contained in the supply, is conveyed downwardly by two vertical parallel belt conveyors below the fork and spaced from each other a distance sufficient to permit the passage therebetween of the base of said cone, said belt conveyors bearing lugs which move in synchronized opposition to each other and on which the cone rests such that when said lugs arrive adjacent the street, they free the cone to fall to the street in a vertical position.

5. The device according to claim 1, wherein said supply comprises internally adjacent its upper end a floating cap free to move along interior walls of said supply between two extreme positions determined by abutments, to follow the cones during movement of the cones through said supply, said cap comprising at least one opening of a shape complementary to the body of the cone to maintain axial movement of the cones within said supply.

6. The device according to claim 1, further comprising a device for collecting the cones, said collecting device comprising means for knocking down the cones so that they lie on the street, means for erecting the cone disposed downstream of the knock down means in the direction of advance of the vehicle and which, in the course of advance of the vehicle, enter within the knocked down cone to erect it by pivoting of said erecting means, and said erecting means raising the cone to bring the base of the cone above the upper surface of the platform substantially into contact with the lower plane of the fingers of the fork, said body passing between the fingers to enter the supply positioned above the fork, such that each supply which approaches the fork receives and drives along the platform the cone introduced within the supply.

7. The device according to claim 6, wherein the collecting device further comprises means for guiding the cones which are not aligned with the direction of travel of the vehicle, said guide means being constituted by arms that converge between the knock down means and the erecting means, to delimit a guide path in the form of a forwardly-opening funnel.

8. The device according to claim 7, further comprising a turn over device which permits during advance of the vehicle a rotation by 180° of a cone about its base when the summit of the cone points rearward with respect to the direction of travel of the vehicle.

9. The device according to claim 8, wherein the turn over device constitutes a substantially horizontal axle movable parallel to itself and disposed perpendicular to the longitudinal axis of the vehicle on one side of the vehicle, said axle supporting a dihedral formed of two plates mounted freely rotatably by a common edge on said axle.

10. The device according to claim 1, wherein said fingers of said fork are articulated about a heel.

11. The device according to claim 1, further comprising an arm articulatedly carried by the vehicle, said arm having a variable opening angle as a function of the advance of the vehicle to position cones on the bias so as to form a diagonal line on the street.

* * * * *